US005151706A

United States Patent [19]

Roederer et al.

[11] Patent Number: 5,151,706

[45] Date of Patent: Sep. 29, 1992

[54] APPARATUS FOR ELECTRONICALLY CONTROLLING THE RADIATION PATTERN OF AN ANTENNA HAVING ONE OR MORE BEAMS OF VARIABLE WIDTH AND/OR DIRECTION

[75] Inventors: Antoine Roederer, Noordwljk; Cornelis Van't Klooster, Voorhout, both of Netherlands

[73] Assignee: Agence Spatiale Europeenne, France

[21] Appl. No.: 828,266

[22] Filed: Jan. 29, 1992

[30] Foreign Application Priority Data

Jan. 31, 1991 [FR] France ..... 91 01086

[51] Int. Cl.[5] ..... H01Q 3/26; H01Q 3/36; H01Q 3/40

[52] U.S. Cl. ..... 342/372; 342/373

[58] Field of Search ..... 342/368, 371, 372, 373, 342/374, 375, 403

[56] References Cited

U.S. PATENT DOCUMENTS

| | | | |
|---|---|---|---|
| Re. 31,772 | 12/1984 | Gerst et al. | 342/373 |
| 3,731,315 | 4/1972 | Sheleg | 342/373 |
| 4,124,852 | 1/1977 | Steudel | 342/374 |
| 4,286,267 | 8/1981 | Schwierz | 342/372 |
| 4,414,550 | 11/1983 | Tresselt | 342/373 X |
| 4,639,732 | 1/1987 | Acoraci et al. | 342/371 |
| 4,814,775 | 3/1989 | Raab et al. | 342/373 |
| 4,901,085 | 9/1988 | Spring et al. | 342/373 |
| 4,916,454 | 4/1990 | Bull et al. | 342/373 |
| 4,973,971 | 11/1990 | Sinsky et al. | 342/373 |
| 4,994,814 | 2/1991 | Aoki et al. | 342/372 |
| 5,028,930 | 7/1991 | Evans | 342/373 |
| 5,038,149 | 8/1991 | Aubry et al. | 342/372 |
| 5,038,150 | 8/1991 | Bains | 342/373 |
| 5,081,463 | 1/1992 | Hariu et al. | 342/372 |
| 5,093,668 | 3/1992 | Sreenivas | 342/374 |

FOREIGN PATENT DOCUMENTS

| | | |
|---|---|---|
| 1527939 | 4/1967 | France . |
| 2241886 | 5/1973 | France . |

*Primary Examiner*—John B. Sotomayor

*Attorney, Agent, or Firm*—Skjerven, Morrill, MacPherson, Franklin & Friel

[57] ABSTRACT

The apparatus comprises: an array of N radiating elements, subdivided into P subarrays of M elements each, each beam of a specified pattern using a plurality of elements selected from the elements of at least some of the subarrays; a common signal source; power divider means having one input and N outputs to distribute the signal delivered by the source; amplifier means for amplifying said signal; and means for selectively exciting at least some of the elements with the amplified signal at a controlled phase shift so as to obtain the radiation pattern specified for the antenna. According to the invention, the apparatus is provided, between the power divider means and the radiating elements, with: P groups of M phase shifter-and-amplifier modules placed at the output of the power divider means; and P couplers each having M inputs and M outputs, said M inputs being connected to the M corresponding outputs of the associated group of phase shifter-and-amplifier modules, and said M outputs being connected to the M elements of the associated subarray. The phase shifts of the phase shifter-and-amplifier modules are selected in such a manner as to direct the power delivered by the source to those radiating elements that contribute to the specified radiation pattern, and thus to provide distributed amplification of the signal emitted by the source while maintaining an essentially identical and constant load on each amplifier regardless of the changes made to the radiation pattern.

7 Claims, 4 Drawing Sheets

APPARATUS FOR ELECTRONICALLY CONTROLLING THE RADIATION PATTERN OF AN ANTENNA HAVING ONE OR MORE BEAMS OF VARIABLE WIDTH AND/OR DIRECTION

The present invention relates to apparatus for electronically controlling the radiation pattern of an antenna having one or more beams of variable width and/or direction.

BACKGROUND OF THE INVENTION

The invention is particularly suitable for implementing so-called "despun" antennas which are continuous scanning antennas mounted on a satellite that is itself subject to permanent rotary motion about its own axis, and in which the beam of the antenna is scanned at the same speed of rotation as the satellite but in the opposite direction so as to maintain a constant pointing direction in spite of the rotation of the satellite.

Although such a configuration constitutes one of the advantageous implementations of the invention, the invention is itself is in no way limited thereto and, as described below, the teaching of the invention may be applied to a very wide variety of antennas having one or more beams that are electronically controlled.

Similarly, the antenna is described below essentially in terms of transmission, but all of the teaching can be transposed, mutatis mutandis, to operation in reception merely by applying the principle of reciprocity, with the structure of the circuits and their interconnections remaining the same but with the signals traveling from the antenna array towards the transmit/receive circuits instead of traveling in the opposite direction. Under such circumstances, the amplifier stages which are located in the same positions become low-noise amplifier stages with their inputs being connected to the antenna and their outputs being connected to the transmit/-receive circuit. Indeed, both types of amplifier (i.e. power amplifiers for transmission and low-noise amplifiers for reception) may coexist in the same module, providing appropriate duplexing or switching is provided.

When radio power is to be radiated (or received) by electronically scanning one or more beams over a wide angular range with optimum efficiency, it is possible to use passive antennas or else to use active antennas.

In essence, so-called "passive" antennas include a main amplifier followed by a fixed or variable power divider together with phase shifters and/or switches.

For transmission, the main drawbacks are: the need to provide a generator of high power (since there is only one amplifier); the occurrence of significant losses downstream from the generator (since the generator is situated upstream from the remainder of the apparatus); and the need to perform switching at high power level. Conversely, on reception, since the low-noise amplifier is situated at the downstream end of the system, the signal is subjected to large losses prior to being amplified, thereby significantly degrading its signal-to-noise ratio.

Finally, and in all cases, having only one amplifier for transmission and/or reception means that a breakdown in the amplifier completely prevents the system from operating since "degraded" mode operation is not possible, i.e. a single fault can completely interrupt the process of transmission or of reception.

An example of one such passive antenna is shown in FIGS. 1 and 2, comprising a circular array 10 having a large number of radiating elements (thirty-two in this example) that are uniformly distributed around a cylindrical surface, as shown diagrammatically in FIG. 2 which is a plan view of the array 10. Successive elements in the circular array are numbered 1 to 32.

The array 10 is fed from a signal source 20. The signal is amplified by a stage 30 and is applied to a beam-forming and scanning network 40, 50 including firstly a power dividing stage 40 and secondly a series of four-way switches 50. In this example, the power dividing stage 40 includes a four-path power divider 41 whose outputs are applied to the inputs of variable two-path dividers 42. The divider 41 is an equal-amplitude and equal-phase fixed divider, whereas the dividers 42 are variable-amplitude equal-phase dividers.

Each of the outputs from the variable power dividers 42 is connected to a four-way switch 50 that feeds four non-contiguous radiating elements in the circular array, which elements are angularly offset from one another at 90° intervals. The output from each divider 42 is thus applied to one of the radiating elements in a subarray, with each subarray being constituted by the four radiating elements having the numbers indicated in the figure (the first subarray is constituted by elements having numbers 1, 9, 17, and 25, the second subarray by elements having numbers 5, 13, 21, and 29, etc.).

By an appropriate combination of variable phase shifts (dividers 42) and switch positions (switches 50), it is possible to cause the beam to scan circularly in a progressive manner: for example the three middle elements (e.g. the elements 2, 3, and 4) are excited in-phase and each with one-fourth of the power, while the remaining fourth is distributed in a manner that varies progressively from one of the outer elements (in this example the element 1) to the other (the element 5) while remaining in phase, thereby obtaining a progressive scan.

This configuration is not free from drawbacks. The main drawback is the very large loss of power between the signal at the output of the amplifier and the signal that is effectively radiated by the array, with this power loss being due to the large number of components passed through. The power loss is generally in the order of 40%.

Another drawback comes from the fact that since scanning is performed by acting on amplitudes only, the phases with which the radiating elements are excited are far from optimum, thereby degrading the quality of the beam.

Another known configuration, as described for example in an article by Boris Sheleg entitled "A matrix-fed circular array for continuous scanning", published in the Proceedings of the IEEE, Vol. 56, No. 11, November, 1968, at pp. 2016 to 2027, uses a single Butler matrix for a similar application.

As shown diagrammatically in FIG. 3, that configuration includes an assembly between the array 10 and the signal source 20 together with its power amplifier 30, which assembly is constituted, from its upstream end to its downstream end by: an equal-amplitude and equal-phase power divider 40 including as many outputs as there are radiating elements; a phase shifting assembly 60 comprising a fixed phase shifter 61 and a variable phase shifter 62 for each of the outputs of the divider 40; and a Butler matrix 70 whose inputs are connected to the outputs of the phase shifters and whose outputs are connected to the various radiating elements of the array 10. (As is known, a Butler matrix is a passive array, theoretically having zero loss, comprising N inputs and N outputs where N is generally a power of 2; the inputs are isolated from one another and a signal applied to any one of the inputs produces currents on all of the outputs, which currents are equal in amplitude but of phase that varies linearly from one element to the next.)

In the apparatus of FIG. 3, scanning is performed by acting on the phase shifters 62 so as to obtain a linear change of phase on the mode inputs while maintaining mode amplitudes that are constant.

Although such a structure eliminates the difficulties associated with switches, it nevertheless suffers from the other drawbacks of the apparatus of FIG. 1.

The second type of antenna is constituted by so-called "active" antennas in which amplification is no longer concentrated at a single point, but is distributed over a plurality of amplifiers.

More precisely, each radiating element is associated with an amplifier connected in the immediate vicinity of the element. The main drawback is that for an antenna having four (or six) facettes, for example, only one amplifier in four (or six) is in use at any given instant, with all of the power being concentrated in the single amplifier associated with the corresponding element in use. This drawback limits the use of this principle to antennas that are required to have a wide scanning range.

In addition, U.S. Pat. No. 4,901,085 in the name of Spring et al. describes a configuration for a multiple beam antenna feed system comprising a plurality of modules forming hybrid matrix power amplifiers. Each of these modules (which are preferably all identical) includes an input matrix and an output matrix having mirror symmetry with each other and interconnected by a battery of power amplifiers. Each of the modules made in this way is connected between a low-level beam-forming network and the radiating elements.

Such a structure requires twice the number of matrices and is thus relatively complex, bulky, and heavy—all of which characteristics are highly disadvantageous for an antenna on board a satellite.

Secondly, in the configuration described in this patent, the beam-forming network connects certain beam-selection ports to certain input ports of the modules, while no signal is applied to certain other ports thereof. As a result the various amplifiers are not identically loaded, and this gives rise to a loss of efficiency in the system.

Finally, and above all, the system described in this prior art does not enable the beam pointing direction to be varied continuously while conserving uniform loading on the amplifiers, whereas this constitutes the essential characteristics of the present invention, as described below.

One of the objects of the present invention is to provide apparatus for electronically controlling the radiation pattern of an electronically-scanned active antenna having one or more beams and operating over a wide angular range with optimum efficiency.

Essentially, this apparatus includes an array of radiating elements subdivided into a number of groups, each beam typically using one or two elements in each group. Amplification takes place in distributed manner using a plurality of amplifiers, with the number of amplifiers being equal to the number of radiating elements, and the connections between the radiating elements and the amplifiers are provided via respective hybrid couplers, means also being provided to optimize and adjust the phases of the signals prior to amplification (in transmission) or after amplification (in reception) so as to control the distribution of energy between the elements.

By applying suitable shifts, this makes it possible to direct the power in the best possible manner to the elements that correspond to the desired pointing direction(s), and to vary power continuously from one portion of the antenna to another so as to change its radiation pattern.

In addition, compared with an active antenna having an amplifier module associated directly with each radiating element, amplification that is distributed in accordance with the present invention has the advantage that power per module can be reduced essentially in the ratio of the number of elements contributing to a beam divided by the total number of elements.

Two advantages are thus obtained: firstly the unit power of the amplifiers is reduced, thereby increasing reliability; and secondly, in the event of one or two of the amplifiers failing, overall performance is little affected by the failure since at any given instant all of the amplifiers in the apparatus ar contributing equally to forming the beam.

In addition, all of the amplifiers are permanently in receipt of signals of equal amplitudes so it is possible to optimize the efficiency of the amplification function.

SUMMARY OF THE INVENTION

The present invention provides apparatus of the above-specified generic type, i.e. comprising: an array of N radiating elements, subdivided into P subarrays of M elements each, where $M \cdot P = N$, each beam of the specified pattern using a plurality of elements selected from the elements of at least some of the subarrays; a signal source common to all of the elements of the array; power divider means having one inlet and N outlets to distribute the signal delivered by the source; amplifier means for amplifying said signal; and means for selectively exciting at least some of the elements with the amplified signal at a controlled phase shift so as to obtain the radiation pattern specified for the antenna.

According to the invention, the apparatus is provided, between the power divider means and the radiating elements, with:

P groups of M phase shifter-and-amplifier modules placed at the outlet of the power divider means; and P couplers each having M inputs and M outputs, said M inputs being connected t the M corresponding outputs of the associated group of phase shifter-and-amplifier modules, and said M outputs being connected to the M elements of the associated subarray;

the phase shifts of the phase shifter-and-amplifier modules being selected in such a manner as to direct the power delivered by the source to those radiating elements that contribute to the specified radiation pattern, and thus to provide distributed amplification of the signal emitted by the source while maintaining an essentially identical and constant load on each amplifier regardless of the changes made to the radiation pattern.

When the pattern comprises a plurality of distinct beams, the said power divider means may include, in particular, the same number of elementary power divider assemblies having one input and N outputs as there are beams, with corresponding outputs of respective elementary assemblies being coupled together by variable phase-shifter means to provide N outputs applied to the N inputs of the N phase shifter-and-amplifier modules.

Advantageously said array is a cylindrical array excited in such a manner as to produce circular scanning of said beam or of each of said beams, and/or excited in such a manner as to modify the width of said beam or of each of said beams.

BRIEF DESCRIPTION OF THE DRAWINGS

Embodiments of the invention are described by way of example with reference to the accompanying drawings, in which.

Above-mentioned

Above-mentioned

DETAILED DESCRIPTION

Figure 1:
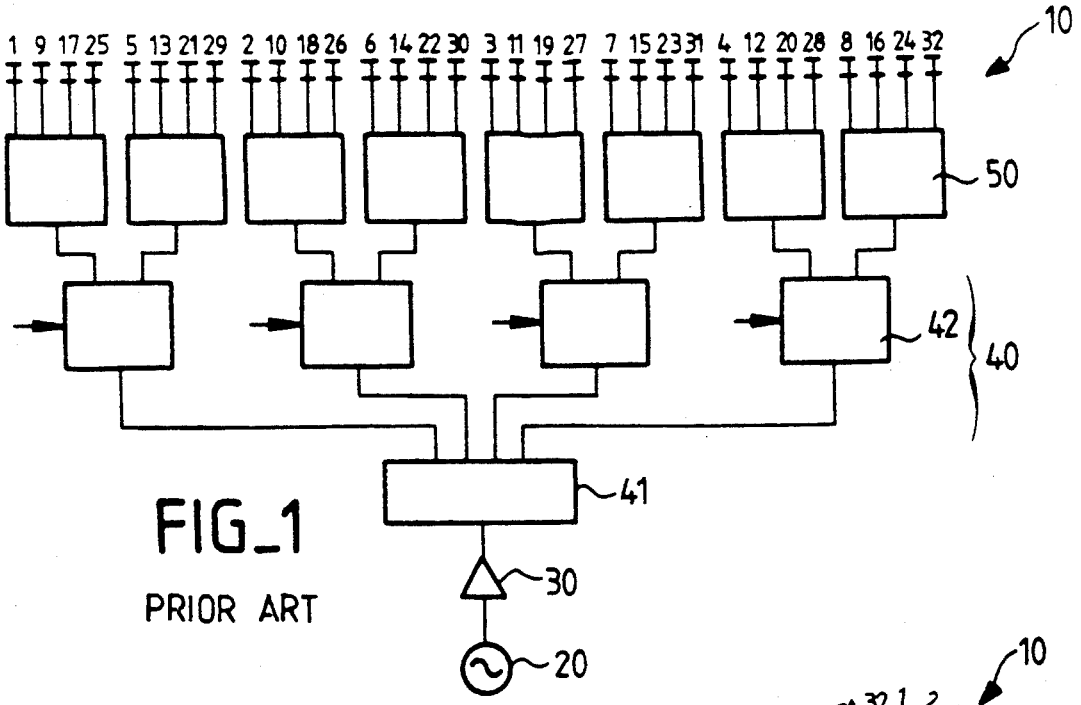
FIG 1 PRIOR ART
FIGS. 1 and 2 are diagrams of a first prior art circular-scanning passive antenna.
Figure 2:
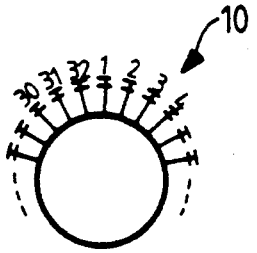
FIG 2 PRIOR ART
Figure 3:
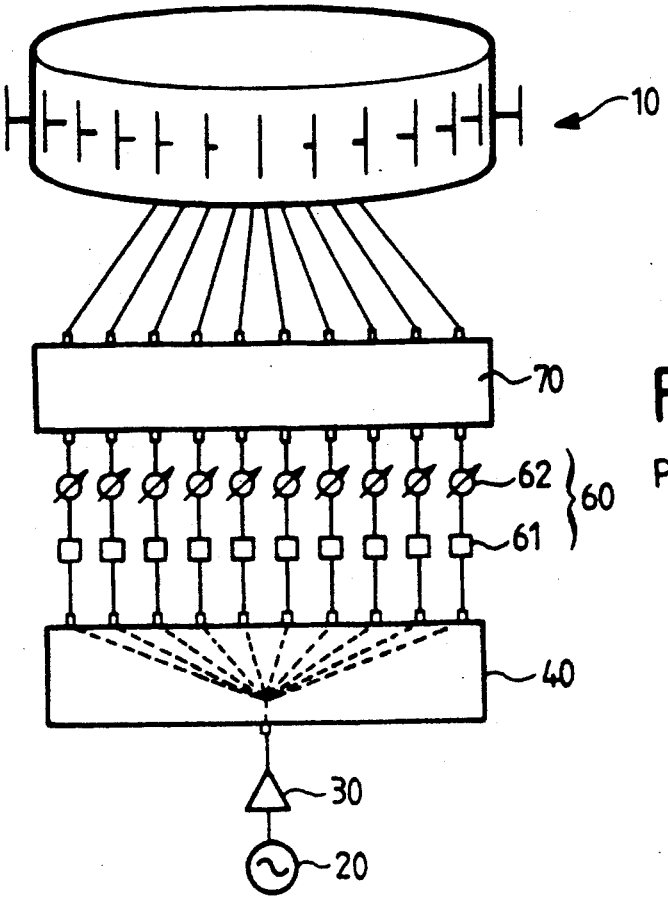
FIG 3 PRIOR ART
FIG. 3 shows a second prior art circular-scanning passive antenna.
Figure 4:
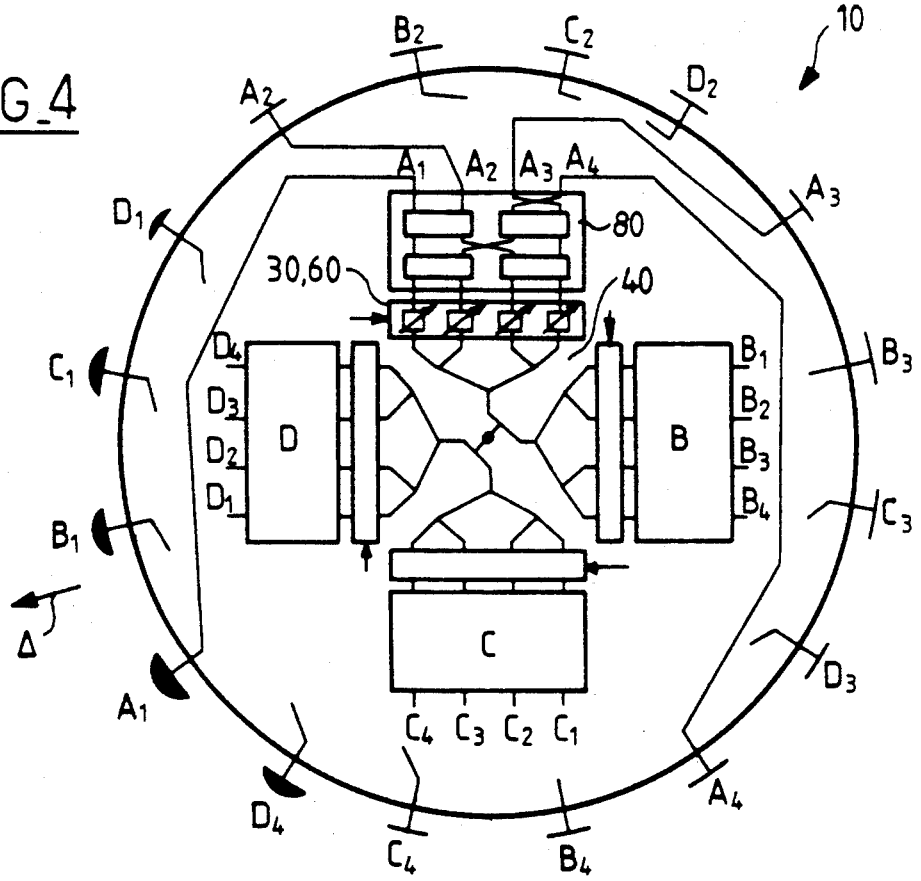
FIGS. 4 and 5 are diagrams of a first embodiment of the apparatus of the invention, corresponding to a single-beam circular-scanning antenna.
Figure 5:
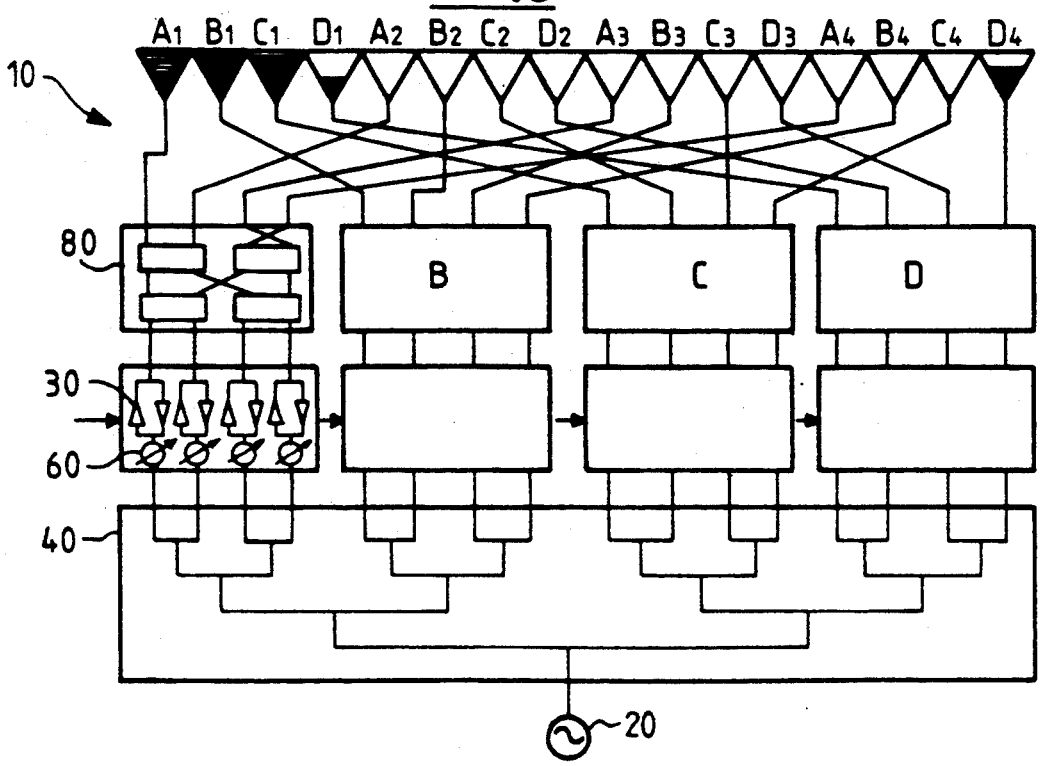

FIGS. 4 and 5 show a first embodiment of the invention for a cylindrical antenna having sixteen radiating elements and a single beam. Typically, such a configuration corresponds to a despun antenna for a satellite, but naturally many other applications may also be envisaged.

FIG. 4 is a plan view showing the overall configuration of the circular array and of the circuits associated therewith, whereas FIG. 5 relates solely to the electrical circuit defining the connections between the various items of the circular array.

The radiating elements of the array 10 are subdivided into groups A, B, C, and D, each having four radiating elements (A1, A2, A3, A4, etc.), with the beam typically making use of one or two elements in each group. Thus, in the example shown, the beam of direction Δ makes use of five elements: A1, B1, C1, D1, and D4. Typically, each of the elements A1, B1, and C1 is excited by one-fourth of the total power, while the remaining fourth is shared between the two elements D1 and D4, with the shares being varied continuously (greater and lesser power levels are symbolized in FIGS. 4 and 5 by greater and lesser amounts of shading associated with each excited element).

The phases of the middle three sources (in this example the sources A1, B1, and C1) may be optimized, while the phases of the outer two sources (D1 and D4) are equal but adjustable in value: it is thus possible to maximize radiation in a variable direction either continuously or otherwise.

Each group of radiating elements is associated with a generalized multiport coupler 80, or a Butler matrix, having four inlets and four outlets in the example shown. Such couplers and their operating conditions are described, for example in the work by Y. T. Lo and S. W. Lee entitled "Antenna handbook—theory, applications and design", published by Van Nostrand Reinhold Company, New York, and in particular at pages 19–101 to 19–111 in the "Beam-forming feeds" chapter, and also in the article by S. Egami and M. Kawai entitled "An adaptive multiple beam system concept", published in IEEE Journal on Selected Areas in Communications, Vol. SAC-5, No. 4, May, 1987, pp. 630 to 636.

Each of the couplers 80 associated with the various groups A, B, C, and D enables each element of a group (e.g. for the coupler of group A, the radiating elements A1, A2, A3, and A4) to be connected to an equal number of amplifier-and-phase shifter modules comprising amplifiers 30 and phase shifters 60, with the phase shifters being variable and controllable so as to adjust phase shift prior to amplification (during transmission) or after amplification (during reception).

Each of the phase shifters 60 (of which there are thus $4\times4=16$) is fed by one of the outputs of an equal-amplitude, equal-phase power divider 40 which is itself fed by the signal source 20 (or vice versa on reception).

The properties of the couplers 80 are such that by an appropriate choice of the phases applied by the phase shifters 60 to the signals from the divider 40, it is possible to focus the inlet power to one, two, or four of the outputs of the coupler. In this case, the power is focused towards one or two of the outputs to obtain the desired result. In addition, when two outputs are in use, it is possible to adjust the relative levels between them, and also to some extent their relative phases, thereby directing the power as well as possible towards the radiating elements corresponding to the specified direction of radiation.

Figure 6:
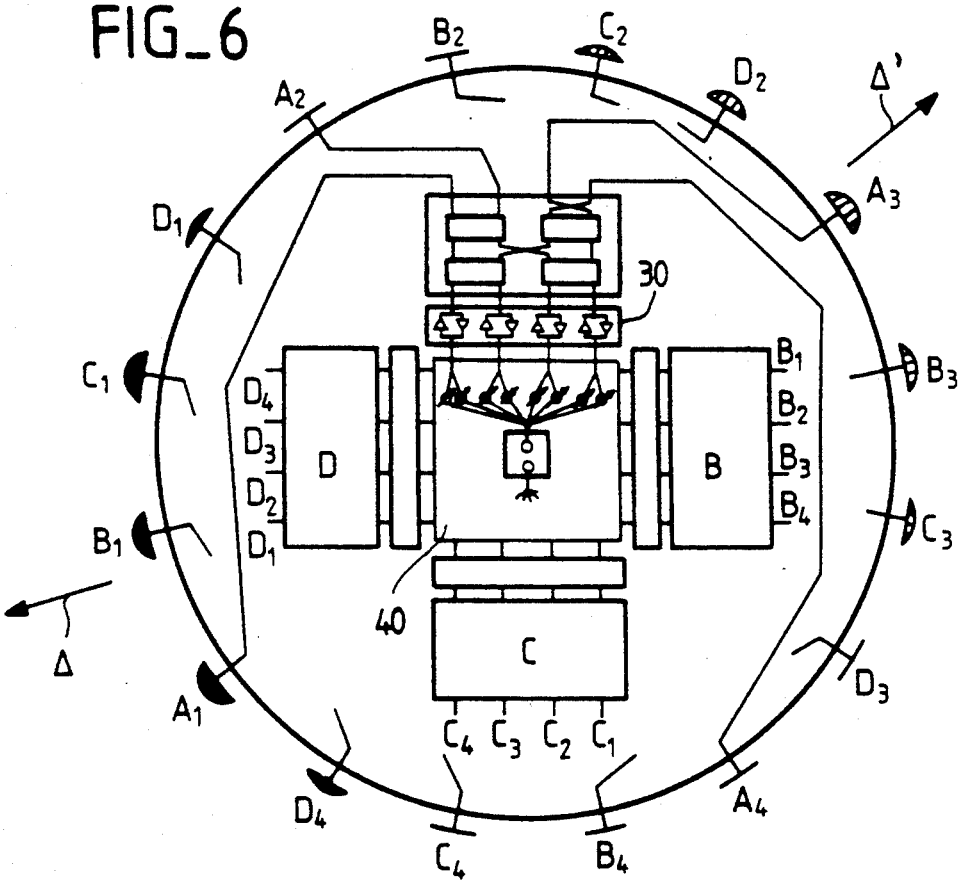
FIGS. 6 and 7 show a second embodiment of the invention corresponding to a circular-scanning antenna having two simultaneous beams.
Figure 7:
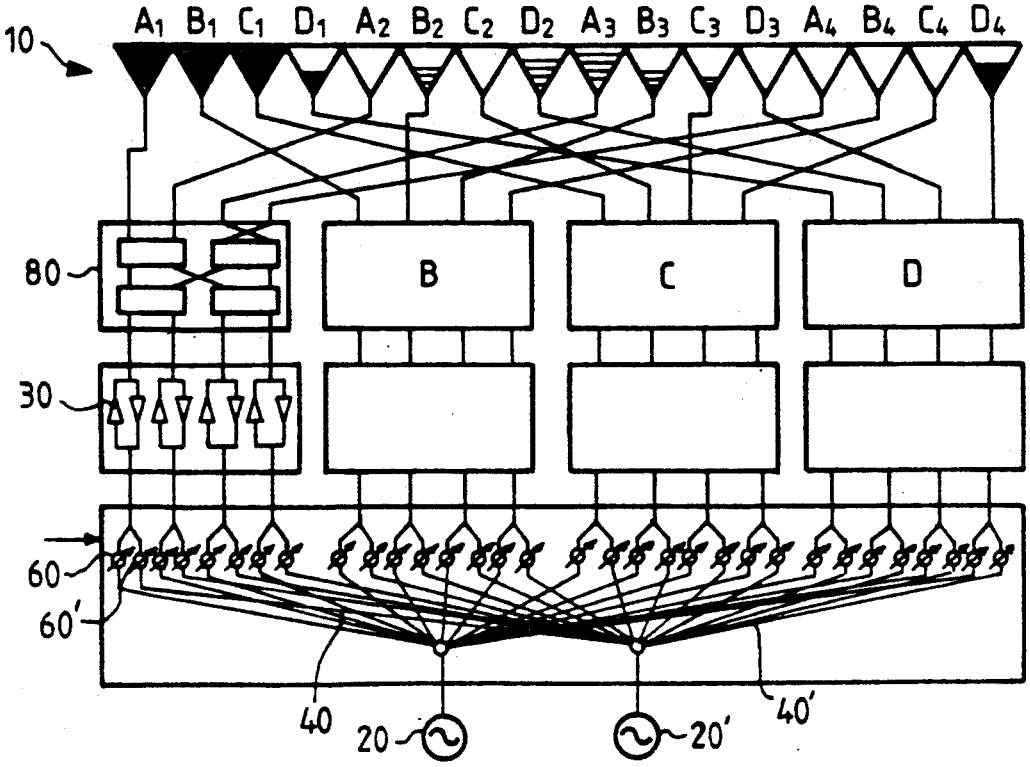

FIGS. 6 and 7 show a generalization of the above embodiment to a circularly scanning antenna having two simultaneous beams, corresponding to two different directions referenced Δ and Δ'.

As can be seen in the figures, its structure is comparable to the preceding case with respect to the multiple couplers 80 and the amplifiers 30.

In contrast, because of the plurality of beams, and thus the plurality of sources (20 and 20'), the number of phase shifters is doubled. It can thus be seen that each of the amplifiers 30 is associated with two phase shifters 60 and 60' thus enabling signals from two sources 20 and 20' to be coupled while applying appropriate different phase shifts to them separately.

Figure 8:
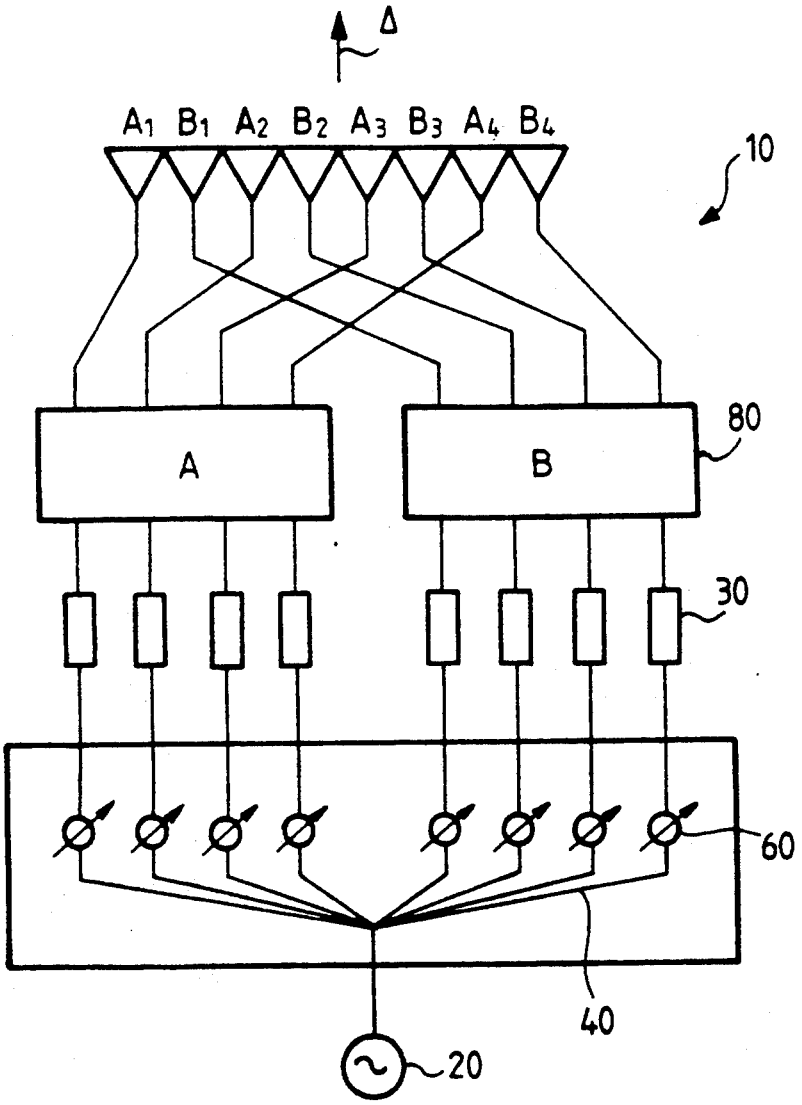
FIG. 8 shows a third embodiment of the invention corresponding to a fixed-pointing single-beam antenna where the beam width is variable.

FIG. 8 shows another embodiment of the invention to a "zoom" antenna application, i.e. to an application that produces a beam in a given direction (Δ) but of width that varies as a function of requirements. In particular, such antennas may be very useful in satellites having highly eccentric elliptical orbits since they enable an illumination zone to be kept substantially constant in spite of periodic variations in the altitude of the satellite.

To this end, the number of radiating elements in use is varied, with a wide beam using a small number of radiating elements while a highly-directive beam uses a larger number. Thus, in the example of FIG. 8, a circular or planar array of eight elements is used with the element being organized in two overlapping groups A1, A2, A3, A4, and B1, B2, B3, B4. A wide beam uses the two central elements B2 and A3, a beam that is a little less wide uses the four central elements A2, B2, A3, B3, etc., with the narrowest beam being produced by using all of the elements. It may be observed that in this case all of the elements are pointing in the same direction and that the beam may also be enlarged in conventional manner by means of an optical system.

The four radiating elements in each of the two groups are connected to the first series of ports of a corresponding coupler 80 whose second series of ports is connected to the same number of amplifiers 30 as there are radiating elements. Each amplifier is associated with a phase shifter module 60 which is itself fed by one of the outputs of the power divider 40 which is fed by the signal source 20.

The teaching of the present invention may be applied to a wide variety of antenna configurations, and in addition to the above-described configurations of despun antennas for satellites and "zoom" antennas of variable-beam width, the following configurations may be mentioned:

remote control and telemetry antennas for satellites, space, probes, space planes, and launchers;

communications antennas for communications between space vehicles;

antennas for astronauts;

antennas for mobile terminals, at sea, in the air, or on land;

antennas for radio beacons or buoys that interchange signals (in transmission and/or reception) with satellites or aircraft;

antennas for navigation terminals using satellites;

antennas for receiving TV from satellites located in different positions; and antennas for stationary or mobile radars.

Depending on requirements, the radiating elements in the array may be distributed over a shaped surface that is spherical, cylindrical, conical, or facetted in order to extend the angular range of the antenna.

We claim:

1. Apparatus for electronically controlling the radiation pattern of an antenna having one or more beams of variable width and/or direction, the apparatus comprising:

an array of N radiating elements, subdivided into P subarrays of M elements each, where $M \cdot P = N$, each beam of a specified pattern using a plurality of elements selected from the elements of at least some of the subarrays;

a signal source common to all of the elements of the array;

power divider means having one input and N outputs to distribute the signal delivered by the source;

amplifier means for amplifying said signal; and means for selectively exciting at least some of the elements with the amplified signal at a controlled phase shift so as to obtain the specified radiation pattern for the antenna;

the apparatus further comprising, between the power divider means and the radiating elements:

P groups of M phase shifter-and-amplifier modules placed at the output of the power divider means; and P couplers each having M inputs and M outputs, said M inputs being connected to the M corresponding outputs of the associated group of phase shifter-and-amplifier modules, and said M outputs being connected to the M elements of the associated subarray;

the phase shifts of the phase shifter-and-amplifier modules being selected in such a manner as to direct the power delivered by the source to those radiating elements that contribute to the specified radiation pattern, and thus to provide distributed amplification of the signal emitted by the source while maintaining an essentially identical and constant load on each amplifier regardless of the changes made to the radiation pattern.

2. Apparatus according to claim 1 in which the pattern includes a plurality of distinct beams, said power dividing means including the same number of elementary power dividing assemblies as there are beams each having one input and N outputs, the corresponding outputs of respective elementary assemblies being coupled by variable phase shifter means to provide N outputs applied to the N inputs of the N phase shifter-and-amplifier modules.

3. Apparatus according to claim 1, in which said array is a cylindrical array which is excited in such a manner as to cause said beam or each of said beams to scan circularly.

4. Apparatus according to claim 1, in which the array is an array that is excited in such a manner as to change the width of said beam or of each of said beams.

5. Apparatus according to claim 1, in which the array elements are disposed on a conical surface.

6. Apparatus according to claim 1, in which the array elements are disposed on planar facets around the central axis of the antenna.

7. Apparatus according to claim 1, in which the array elements are disposed on a spherical surface or parts thereof.

* * * * *